United States Patent [19]

Levy et al.

[11] Patent Number: 4,540,140

[45] Date of Patent: Sep. 10, 1985

[54] PASSIVE MISSILE GUIDANCE PROCESS

[75] Inventors: Pierre Levy, Boulogne Billancourt; André Robert, Eaubonne, both of France

[73] Assignee: Societe Anonyme de Telecommunications, Paris, France

[21] Appl. No.: 516,120

[22] Filed: Jul. 20, 1983

[30] Foreign Application Priority Data

Jul. 28, 1982 [FR] France ..... 82 13188

[51] Int. Cl.[3] ..... F41G 7/22

[52] U.S. Cl. ..... 244/3.19; 343/424

[58] Field of Search ..... 244/3.15, 3.16, 3.19; 343/424, 445, 357

[56] References Cited

U.S. PATENT DOCUMENTS

| | | | |
|---|---|---|---|
| 3,181,813 | 5/1965 | Gulick, Jr. et al. | 244/3.19 |
| 3,740,002 | 6/1973 | Schaefer | 244/3.19 |
| 4,108,400 | 8/1978 | Groutage et al. | 244/3.15 |
| 4,204,655 | 5/1980 | Gulick et al. | 244/3.19 |
| 4,264,907 | 4/1981 | Durand, Jr. et al. | 244/3.19 |

*Primary Examiner*—Charles T. Jordan

*Attorney, Agent, or Firm*—Jacobs & Jacobs

[57] ABSTRACT

The process consists in guiding the missile firstly by an electromagnetic guidance by interferometric bases up to the proximity of the target, then by infrared guidance up to the target. Electromagnetic guidance is effected by maintaining constant the angle ($\alpha$) between the velocity vector ($\vec{V}$) of the missle (E) and the straight line (R″) passing through the missile (E) and the projection (C″) of the target (C) on the earth (S). The process is particularly applicable to the interception of targets travelling at low altitude above the sea.

5 Claims, 4 Drawing Figures

PASSIVE MISSILE GUIDANCE PROCESS

BACKGROUND OF THE INVENTION

The present invention relates to a passive missile guidance process, particularly with a view to the interception by said missile of a target travelling at low altitude, and particularly above the sea.

Infrared homing of a missile on a target is known to be effected with excellent precision. However, such precision is attained only in the vicinity of the target, the range of the infrared homing heads not exceeding a few kilometers.

Provision must therefore be made to ensure take-over of a missile at a considerable distance from the target by electromagnetic guidance.

Now, the passive electromagnetic guidance of a missile at low altitude, of which the path must be slaved to a target therefore also travelling at low altitude, is rendered very difficult since the guidance processes at present carried out furnish guidance data in elevation which are all the more erroneous as the distance between the missile and the target decreases.

This comes from the fact that the missile guidance system receives not only the radiation directly emitted by the target, but also a radiation reflected on the surface of the sea and appearing to come from the optical image of the target with respect to this surface. When the target is travelling at low or very low altitude, very close to the surface of the sea, it is very difficult to discriminate the two radiations, with the result that the missile is then guided not on the target itself, but on an apparent target located at the intersection of the vertical of the target with the surface of the sea, i.e. projection of the target on this surface.

SUMMARY OF THE INVENTION

It is an object of the present invention to overcome this drawback.

The present invention therefore relates to a passive missile guidance process, particularly with a view to the interception by said missile of a target travelling at low altitude, and particularly above the sea, in which, over at least part of its path, the missile is guided by a passive electromagnetic guidance, characterized in that, on said part of its path, the missile is guided by maintaining constant the angular variation between its velocity vector and the straight line passing through the missile and the projection of the target on the earth's globe.

In the preferred embodiment of the process of the invention, the angular variation in question is of course maintained constant in elevation.

Applicants have in fact observed that, by maintaining this angular variation constant, the path of the missile was firstly ascending, in then curved and finally redescended, i.e. path was substantially elliptic and enabled the missile to approach the target up to an appropriate distance.

The angular variation in elevation is advantageously maintained constant within a range of from 0.5° to 5°, and preferably substantially equal to 1°.

The interest of the process according to the invention is especially obvious when it is carried out for taking over the missile from the start up to the vicinity of the target and when an infrared guidance, which is more precise, then takes over from the electromagnetic guidance of the invention, up to the target, the missile thus being guided over the whole of its path in accordance with a dual-mode process.

In this case, it is advantageous to carry out the process of interferometric guidance of the system forming the subject matter of Applicants' copending French Patent Application No. 82 13108, especially if the missiles are of small dimensions. The infrared system and the electromagnetic system, functioning sequentially, may then be implanted on the head of a missile of small dimensions, thanks to the small dimensions of the aerials of the interferometric bases.

BRIEF DESCRIPTION OF THE DRAWINGS

The invention will be more readily understood on reading the following description with reference to the accompanying drawings, in which.

DETAILED DESCRIPTION OF A PREFERRED EMBODIMENT OF THE INVENTION

Figure 1:
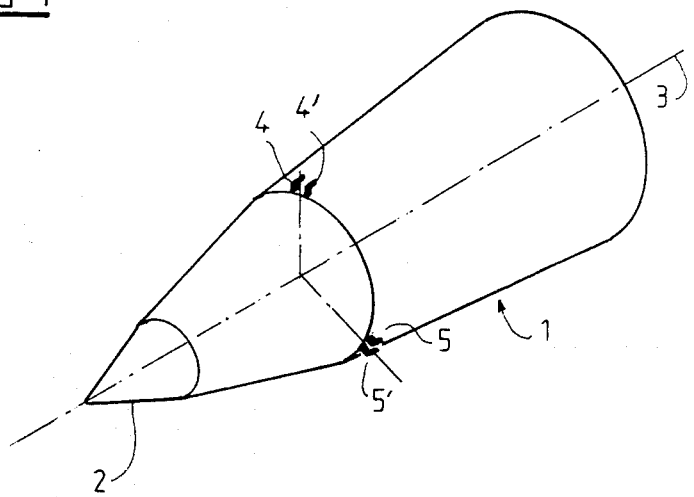
FIG. 1 shows a side view of the head of the missile to be guided according to the process of the invention.
Figure 2:
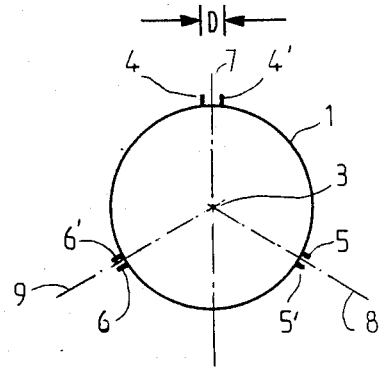
FIG. 2 schematically shows the aerials of the electromagnetic homing heads of the missile of FIG. 1.

Referring now to the drawings, FIG. 1 shows the head of a missile 1 of axis 3, whose path must be slaved to a target to be attained, which emits an electromagnetic radiation, for example by its radar, as well as a natural infrared radiation.

The electromagnetic homing head which will be described is combined with an infrared homing head, known per se, disposed in the front tip 2 of the missile.

The two homing heads, electromagnetic and infrared, form one passive dual-mode homing head, functioning sequentially, the former first, when the missile is taken over and up to proximity of the target, then the latter, up to the target.

On the outer wall of the head 1, very slightly to the rear of tip 2, are fixed, substantially in the same axial plane, three pairs of closely located, small receiver antennas (4, 4'; 5, 5'; 6, 6'), of which one is not visible in FIG. 1, constituting the three aerials of three interferometric bases, identical in the present example, of the electromagentic homing head.

The mediator planes 7, 8, 9 of these three bases are in two's inclined by 120° with respect to one another.

$\theta$ being the angle of incidence of the electromagnetic radiation received by the antennas of one base, D the distance between the two antennas, $\lambda$ the length of the radiation, the phase shift $\Delta\phi$ between the two signals delivered by the two antennas of the base in question is furnished by the relation:

$$\Delta\phi = 2\pi \frac{D}{\lambda} \sin \sigma.$$

Knowing this phase shift, the angle of incidence $\theta$ of the radiation received by the base is therefore deduced by the relation:

$$\sigma = \sin^{-1} \frac{\Delta\phi}{2\pi} \frac{\lambda}{D}.$$

Having three interferometric bases, there are therefore three phase shifts $\Delta\phi_1$, $\Delta\phi_2$, $\Delta\phi_3$ available, from which, after calculation in computing means known per se, data on elevation and bearing in two perpendicular planes may be elaborated in a wide range of use.

Figure 4:
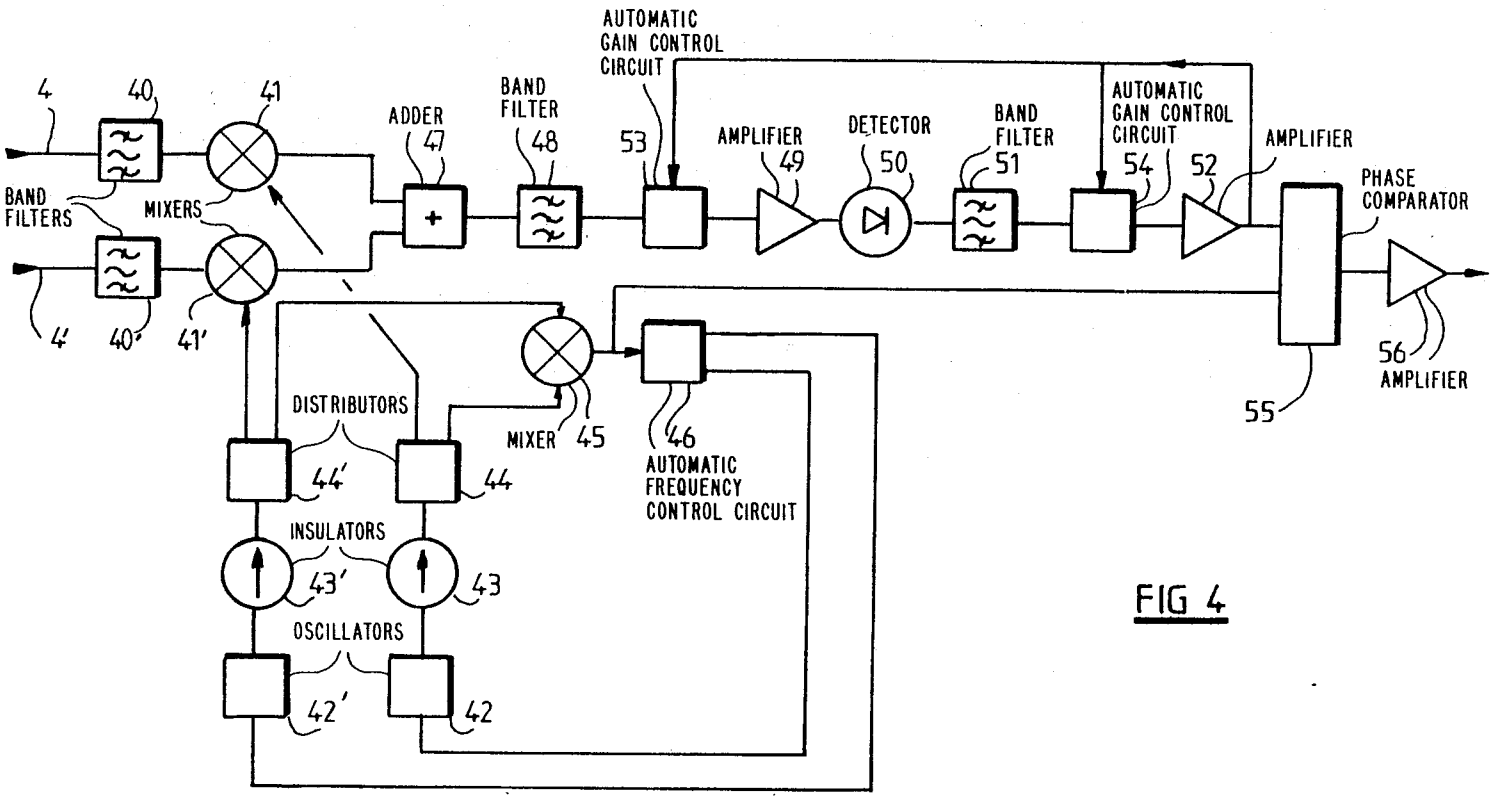
FIG. 4 shows a block diagram of one of the receivers of the missile guidance system of FIG. 1.

Before describing the passive electromagnetic guidance process of the invention more precisely, we shall firstly describe the circuits processing the signals received by the aerials of the interferometric bases and making it possible to obtain the phase shifts in question, with reference to FIG. 4 which concerns one of the three channels associated respectively with the three interferometric bases, the other two being identical.

Each channel in fact comprises a superheterodyne wide band receiver receiving the signals from the two antennas of the base associated therewith, for example 4, 4'.

The signals are firstly received in band filters 40, 40' before undergoing respectively different frequency changes in mixers 41, 41', respectively connected, by their first inputs, to the outputs of filters 40, 40'.

Two local oscillators 42, 42' are to this end connected to the two inputs of the mixers 41, 41', via insulators 43, 43' and distributors 44, 44'. The two distributors 44, 44' are furthermore connected to a mixer 45, itself connected to an automatic frequency control circuit 46, which is looped on the two oscillators 42, 42', in order to maintain constant the difference of their frequencies, equal, in the present example, to 70 MHz.

The two signals at different frequencies issuing from the mixers 41, 41' are added in an adder 47, followed by a band filter 48.

In this way, the two signals issuing from the two receiving antennas of the base, whose frequency is between 5 and 15 GHz, arrive, added at the input of the receiver proper, at a frequency of the order of 1.5 GHz.

At the output of the filter 48 are connected a first amplifier 49, followed by a detector 50, a band filter 51, at the tuning frequency, and by a second amplifier 52.

The output of the second amplifier 52 is reintroduced into two automatic gain control circuits 53, 54 respectively connected between the filter 48 and the amplifier 49, on the one hand, and the filter 51 and the amplifier 52, on the other hand.

At the output of the amplifier 52 is obtained a signal at the tuning frequency equal to the difference between those of the two oscillators 42, 42', and phase shifted with respect to the signal issuing from mixer 45 by the angular variation $\Delta\phi_1$ sought.

The output signal of the amplifier 52 and the output signal of mixer are introduced into a phase comparator 55, which therefore furnishes an error signal indicative of the angular variation information $\Delta\phi_1$. This system is then amplified in an amplifier 56, before being introduced, with the other two signals indicative of the variations $\Delta\phi_2$, $\Delta\phi_3$, in the computing means mentioned above and which furnish the sought angles of elevation and bearing.

The three interferometric bases therefore make it possible to obtain the bearing of a real or apparent electromagnetic source with respect to a reference connected with the missile and therefore with respect to its velocity vector.

Figure 3:
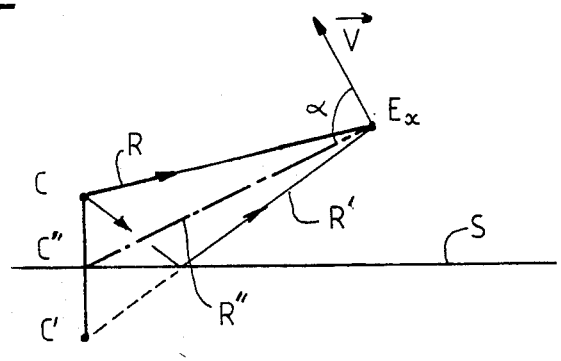
FIG. 3 schematically illustrates the radiations received by the aerials of the missile of FIG. 1.

With reference to FIG. 3, S represents the surface of the earth's globe, in the present case the surface of the sea, $E_x$ the position of the missile to be guided by electromagnetic guidance and $\vec{V}$ its velocity vector at a given instant, C the position of the target and C' the position of its image with respect to the surface S at the same instant. The aerials of the passive electromagnetic homing head therefore receive a direct radiation R and a reflected radiation R' appearing to come from C'. The target C being at very low altitude, the two radiations R and R' are very close to each other, contrary to the representation thereof in the Figure which has been adopted for reasons of clarity, with the result that the aerials receive a radiation R'' appearing to come from the intersection C'' of the vertical of the target C with respect to the surface S, in other words of the projection of the target C on the surface S.

The angle $\alpha$ between the radiation R'' and the velocity vector $\vec{V}$ of the missile is therefore determined with the aid of the interferometric bases and the computing means of the guidance system.

The angle $\alpha$ is compared in a conventional comparator with a so-called correction angle determined at the moment of departure of the missile and introduced into the system. As a function of the error recorded, and via a likewise conventional servo-loop and the device controlling the control surfaces of the missile, the path of the missile is corrected, also in manner known per se, so that this angle remains constant, in the present case equal to 1°, up to a certain distance from the target where, likewise in manner known per se, the infrared homing head takes over from the electromagnetic homing head for guiding the missile.

On that part of its path where it is thus guided by electromagnetic guidance, this path is substantially elliptic, i.e. it begins by being ascending, then it curves and afterwards it redescends.

It is clear that, although the above-described process is optimally applied to guiding small guided missiles on a target travelling at very low altitude above water, the invention is also applicable to guiding missiles of more conventional dimensions at higher altitude, above the ground.

We claim:

1. Process for passive guidance of a guided missile to a target, in which, over at least part of its path, the missile is guided by a passive electromagnetic guidance, wherein, on said part of its path, the missile is guided by maintaining constant the angular variation ($\alpha$) between its velocity vector ($\vec{V}$) and a straight line (R'') passing through the missile (E) and a projection (C'') of the target (C) on the earth's globe (S).

2. The process of claim 1, characterized in that the angular variation ($\alpha$) is maintained constant in bearing.

3. The process of claim 1, characterized in that the angular variation ($\alpha$) is maintained in a range of from 0.5 to 5°.

4. The process of claim 1, characterized in that the missile is guided electromagnetically up to the proximity of the target and thereafter is guided up to the target by an infrared guidance system.

5. The process of claim 4, characterized in that the electromagnetic guidance of the missile is an interferometric guidance.

* * * * *